US008511272B2

(12) United States Patent
Koyama et al.

(10) Patent No.: US 8,511,272 B2
(45) Date of Patent: Aug. 20, 2013

(54) ACCESSORY MOUNTING STRUCTURE

(75) Inventors: Kazuaki Koyama, Okazaki (JP); Sumito Hori, Aichi (JP); Satoshi Matsui, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 976 days.

(21) Appl. No.: 12/268,257

(22) Filed: Nov. 10, 2008

(65) Prior Publication Data

US 2009/0159038 A1 Jun. 25, 2009

(30) Foreign Application Priority Data

Dec. 20, 2007 (JP) ..... 2007-329144

(51) Int. Cl.
*F02B 67/00* (2006.01)

(52) U.S. Cl.
USPC ..... 123/195 A; 123/198 R

(58) Field of Classification Search
USPC ..... 123/195 E, 198 R, 195 A, 195 C, 123/196 S; 248/666, 670, 675, 637, 85; 310/89, 428, 85, 91; 474/133, 135; 210/232
See application file for complete search history.

(56) References Cited

U.S. PATENT DOCUMENTS

| | | | | |
|---|---|---|---|---|
| 3,022,778 | A * | 2/1962 | Stemen | 123/195 E |
| 5,914,549 | A * | 6/1999 | Adachi et al. | 310/89 |
| 5,938,169 | A | 8/1999 | Ogawa et al. | |

FOREIGN PATENT DOCUMENTS

| | | | |
|---|---|---|---|
| DE | 2 246 455 | A1 | 5/1973 |
| JP | 11-107767 | A | 4/1999 |
| JP | 2001-115852 | A | 4/2001 |

* cited by examiner

*Primary Examiner* — Noah Kamen
(74) *Attorney, Agent, or Firm* — Birch, Stewart, Kolasch & Birch, LLP

(57) ABSTRACT

A horizontal groove extending horizontally when an alternator bracket is fixed to a cylinder block of a vehicle engine is formed in the alternator bracket. A shank of a bolt inserted through mounting pieces of an alternator is inserted into the horizontal groove from a horizontally lateral direction toward the cylinder block to support the bolt on a lower surface of the horizontal groove. After insertion, the bolt is restrained from moving toward an opening of the horizontal groove. Since the insertion of the bolt into the horizontal groove is facilitated, and the weight of the alternator is borne by the lower surface of the horizontal groove, a burden on a fixing portion is reduced, and it becomes easy to position the alternator and hold it when it is fixed. Thus, the accessory can be mounted on the cylinder block with satisfactory work efficiency and with support accuracy kept high.

3 Claims, 8 Drawing Sheets

ACCESSORY MOUNTING STRUCTURE

The entire disclosure of Japanese Patent Application No. 2007-329144 filed Dec. 20, 2007 is expressly incorporated by reference herein.

BACKGROUND OF THE INVENTION

1. Field of the Invention

This invention relates to a mounting structure for an accessory which is mounted on a vehicle engine.

2. Description of the Related Art

A vehicle engine is mounted with accessories such as an alternator, a power steering pump, and an air compressor. The accessories are driven by the rotating power of a crankshaft of the vehicle engine which is transmitted via a V-ribbed belt or a V-grooved belt, a pulley, etc. Thus, the accessories are positioned and held on a cylinder block of the vehicle engine so that the pulley of the crankshaft and the pulleys of the accessories will be held within the same plane.

The accessories such as the alternator are held on the cylinder block of the vehicle engine via accessory mounting brackets. That is, the accessory mounting brackets are fixed at predetermined positions of the cylinder block, and the accessories are supported by and fixed to the accessory mounting brackets.

In mounting the accessories, it is necessary to support the accessories, which are heavy objects, by the accessory mounting brackets with ease and with high accuracy. Various mounting structures for improving work efficiency have so far been proposed (see, for example, JP-A-2001-115852).

The technology described in JP-A-2001-115852 is a technology in which a bracket fixed to a cylinder block is provided with a slit opening upward, a bolt (through-bolt) is inserted into a pair of mounting pieces of an alternator, and the through-bolt is inserted from above the slit to mount the alternator. This technology is recognized as being capable of improving the work efficiency for assembling the alternator to the cylinder block.

With the technology described in JP-A-2001-115852, however, it is necessary to insert the through-holt into the slit after lifting the alternator, which is a heavy object, upwardly of the bracket. Thus, much labor is required. Moreover, after the through-bolt is inserted into the slit, the through-bolt is moved within the slit, and the alternator is fixed at a predetermined position. Thus, there is need to adjust the position of the alternator, which is the heavy object, when fixing the alternator. This technology, therefore, does not necessarily result in an increased work efficiency.

Furthermore, a heavy weight is put on bolt holes at a site where the alternator is fixed, and repeated insertion and removal of the bolt for replacement or maintenance of the alternator may decrease the accuracy of the bolt holes. As a result, it may be difficult to maintain the alternator at the predetermined position with high accuracy, and the coplanarity of the pulley of the alternator and the pulley of the crankshaft may fail to be kept.

SUMMARY OF THE INVENTION

The present invention has been accomplished in light of the above-described situations. It is an object of the invention to provide an accessory mounting structure which can mount an accessory on a cylinder block of a vehicle engine with satisfactory work efficiency while keeping support accuracy high.

A first aspect of the present invention is an accessory mounting structure, which includes an accessory mounting bracket for mounting an accessory on a cylinder block, and a bolt for fastening a mounting piece provided in the accessory to the accessory mounting bracket, wherein a horizontal groove extending horizontally when the accessory mounting bracket is fixed to the cylinder block is formed in the accessory mounting bracket; a shank of the bolt is inserted into the horizontal groove from a lateral direction toward the cylinder block; and after the shank of the bolt is inserted into the horizontal groove, the bolt is restrained from moving toward an opening of the horizontal groove.

According to the first aspect of the invention, the shank of the bolt fastening the mounting piece is inserted into the horizontal groove from the lateral direction toward the cylinder block, and the movement of the bolt toward the opening of the horizontal groove is restrained. Thus, during mounting work for the accessory, the labor of lifting the accessory for insertion of the bolt into the horizontal groove is lessened. Further, after the insertion of the bolt, the weight of the accessory is borne within the horizontal groove. Hence, the accessory is held stably, and the labor of supporting the accessory is lessened, thus facilitating the works of positioning and fixing the accessory.

Consequently, the accessory can be mounted on the cylinder block of the vehicle engine with good work efficiency and with support accuracy kept high.

In a second aspect of the present invention, which is the accessory mounting structure according to the first aspect, the mounting piece may be provided on a lower side of the accessory, and after the shank of the bolt is inserted into the horizontal groove, the accessory may be turned about an axis of the bolt as a fulcrum, whereby an upper side of the accessory can be positioned.

According to the second aspect of the invention, the accessory is turned about the axis of the bolt to position the upper side of the accessory. Thus, the accessory, if heavy, can be easily positioned.

In a third aspect of the present invention, the accessory mounting structure according to the second aspect may further comprise a fixing portion to which the upper side of the accessory is fixed; when the accessory mounting bracket is fixed to the cylinder block, the horizontal groove may be located near an outer wall surface of the cylinder block, and the fixing portion may be located to be more spaced from the outer wall surface of the cylinder block than the horizontal groove; and after the shank of the bolt is inserted into the horizontal groove, the shank of the bolt may be borne by a lower surface of the horizontal groove.

According to the third aspect of the invention, during the mounting work for the accessory, the fixing portion is located ahead of the horizontal groove. Thus, the work efficiency in turning the accessory for positioning is further increased. As noted here, the fixing portion is located forwardly of the horizontal groove, and the shank of the bolt is borne by the lower surface of the horizontal groove. Thus, the accessory is turned about the fixing portion as a fulcrum, so that the shank of the bolt does not escape from the horizontal groove. Since the shank of the bolt is borne nearly uniformly along the lower surface of the horizontal groove, the accessory is stably held, and the simple structure can further improve the support accuracy of the accessory.

The accessory mounting structure according to the present invention can mount the accessory on the cylinder block of the vehicle engine with satisfactory work efficiency and with support accuracy kept high.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

An embodiment of the present invention will be described in detail with reference to the accompanying drawings.

Figure 1:
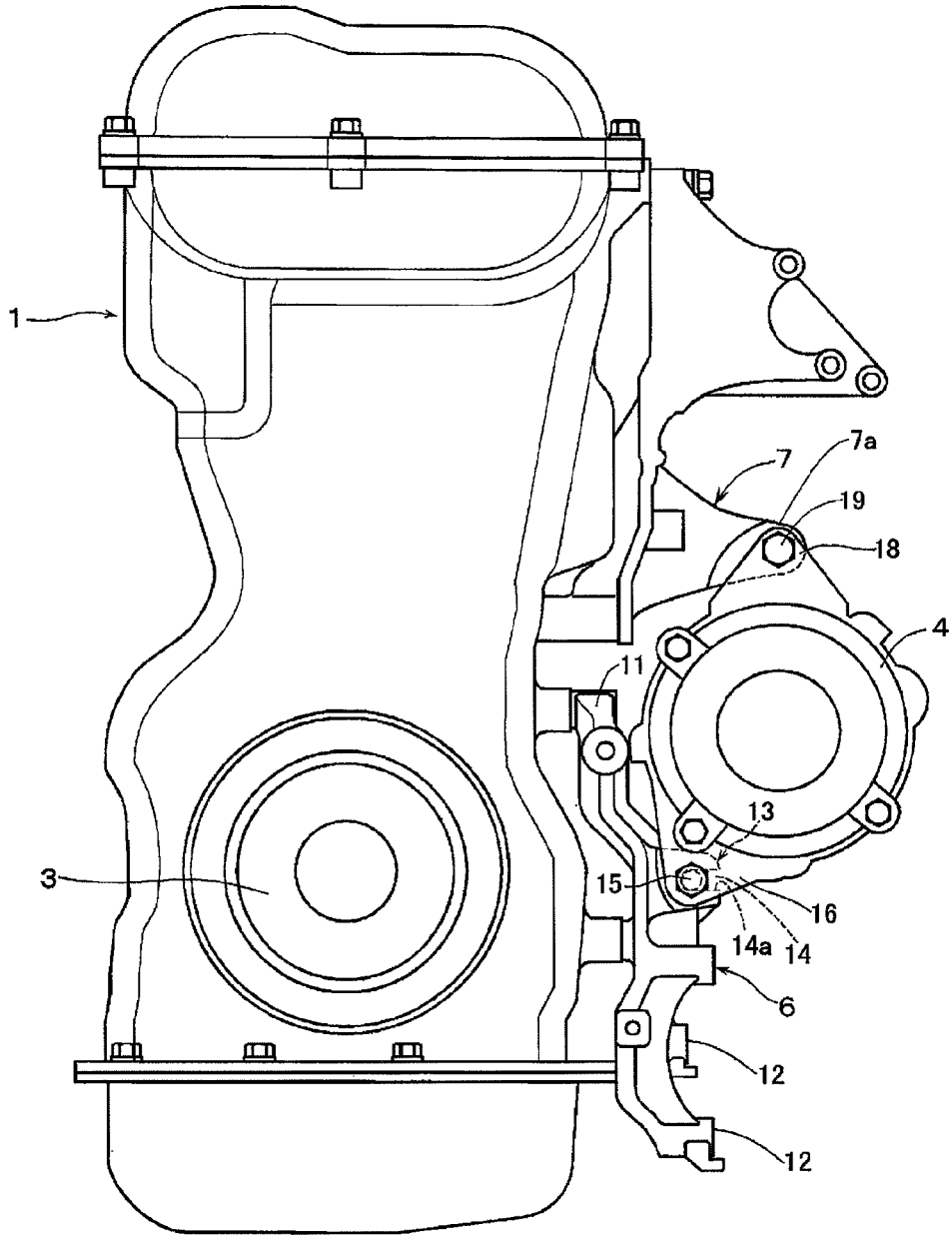
FIG. 1 is a front view of an engine mounted with an alternator by an accessory mounting bracket according to an embodiment of the present invention.
Figure 2:
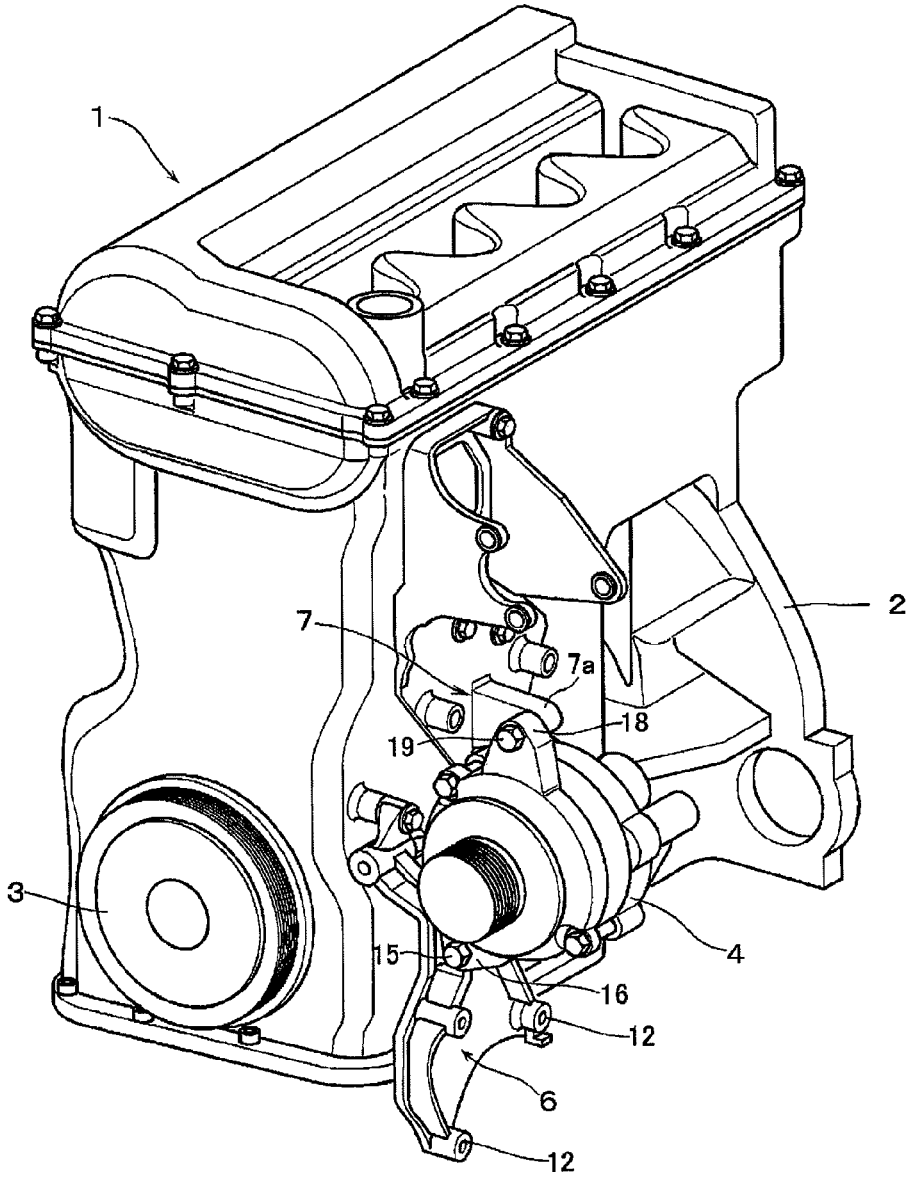
FIG. 2 is an external view of the engine mounted with the alternator.
Figure 3:
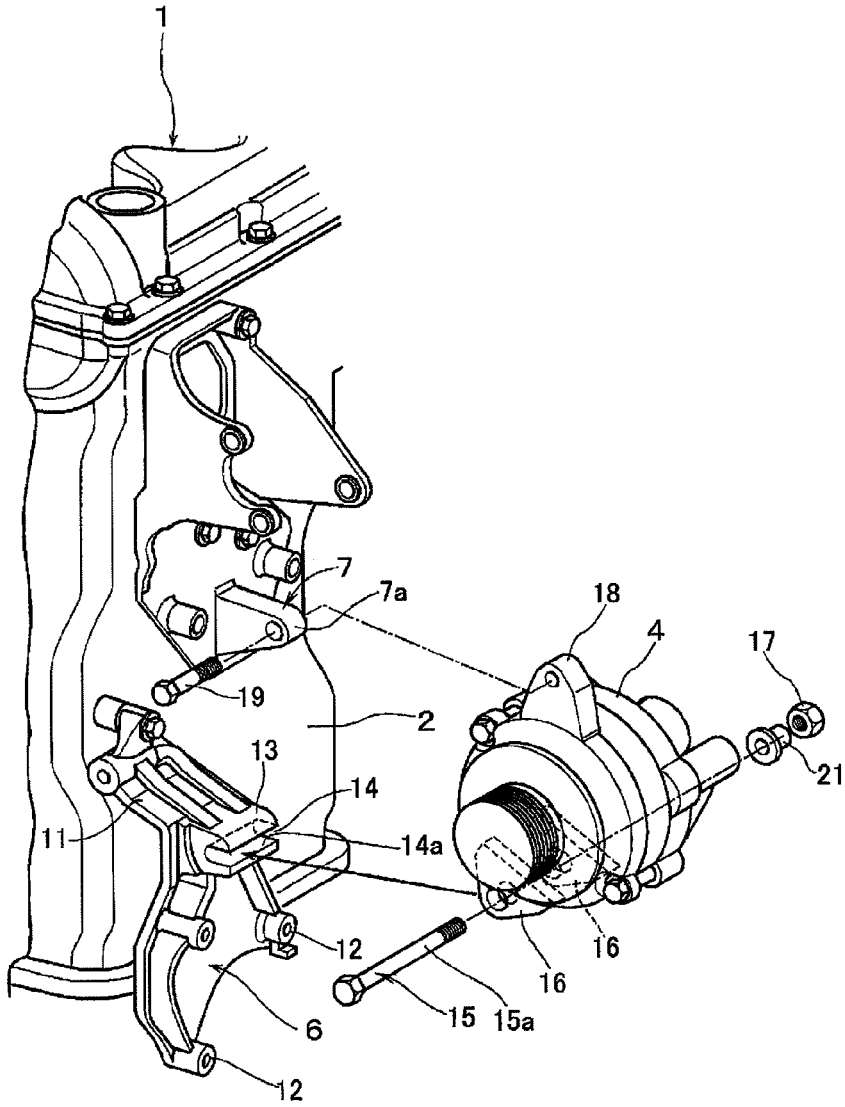
FIG. 3 is an exploded perspective view illustrating an alternator mounting structure according to the embodiment of the present invention.
Figure 4:
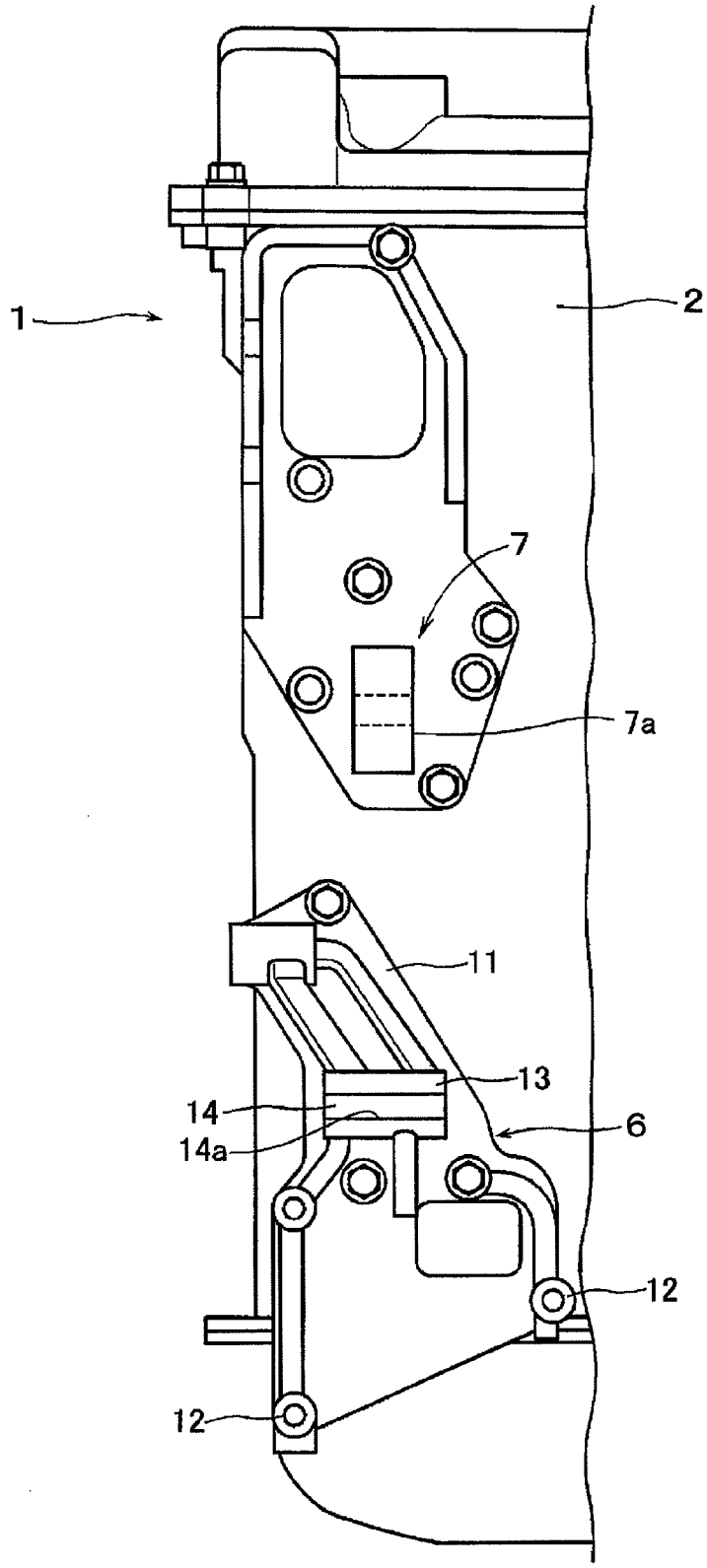
FIG. 4 is a side view of essential parts of the engine showing the mounted status of the accessory mounting bracket.

As shown in FIGS. 1 and 2, a vehicle engine (engine) 1 is an in-line multi-cylinder engine, and a crankshaft pulley 3 connected to a crankshaft is disposed at the front of a cylinder block 2 of the engine 1. On the other hand, an alternator 4 is held, as an accessory, beside the side surface of the cylinder block 2. Further, a power steering pump and an air compressor are held beside the side surface of the cylinder block 2.

A pulley of an accessory, such as the alternator 4, is disposed on the same plane as the crankshaft pulley 3, and a belt is looped over the crankshaft pulley 3 and the pulley of the accessory via an idler pulley and a tension pulley. By so doing, the drive force of the crankshaft of the engine 1 is transmitted to the accessory such as the alternator 4.

As shown in FIGS. 1 to 5, an alternator bracket 6 as an accessory mounting bracket is fixed to a lower part of the side surface of the cylinder block 2, and a power steering pump bracket (PS bracket) 7 as an accessory mounting bracket is fixed to an upper part of the side surface of the cylinder block 2.

The air compressor (not shown) is mounted on a lower part of the alternator bracket 6, and the power steering pump (not shown) is mounted on the PS bracket 7. The alternator 4 is mounted to extend between the alternator bracket 6 and the PS bracket 7.

Amounting structure for the alternator 4, which uses the alternator bracket 6, will be described based on FIGS. 6 to 8A, 8B.

The alternator bracket 6 is furnished with an arm portion 11 fixed to the cylinder block 2 (see FIG. 2), and a lower part of the alternator bracket 6 is provided with boss portions 12 for fixing the air compressor (not shown). A rectangular block-shaped alternator holding portion 13 is provided between the arm portion 11 and the boss portions 12 of the alternator bracket 6, and a horizontal groove 14 is formed in a side surface of the alternator holding portion 13.

Figure 7:
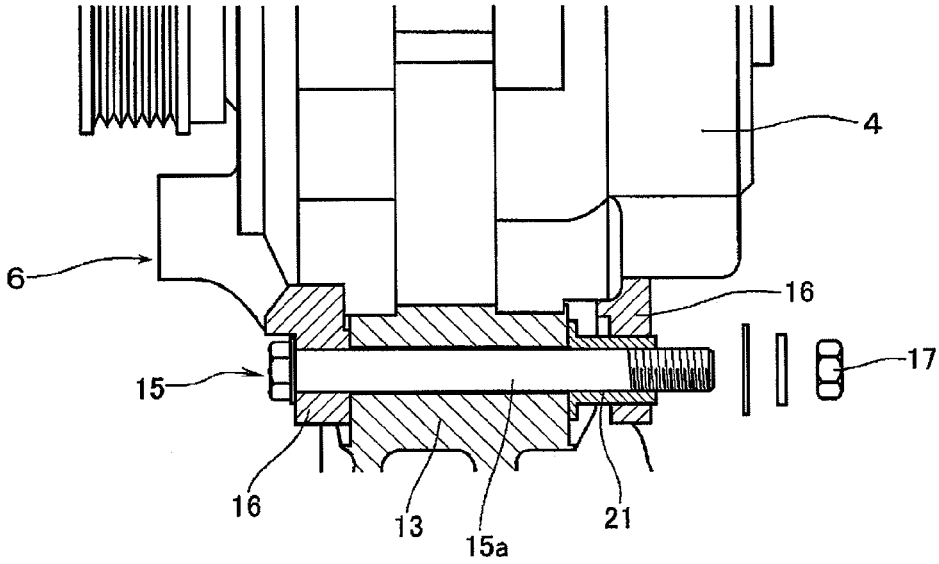
FIG. 7 is a sectional view of essential parts of a support portion for the alternator.

The horizontal groove 14 is a groove formed in a horizontal state in the side surface of the rectangular block-shaped alternator holding portion 13 when the alternator bracket 6 is fixed to the cylinder block 2 (see FIG. 2). As shown in FIG. 7, the horizontal groove 14 is a groove which extends in the right-and-left direction in the drawing (i.e., the direction of parallel arrangement of the cylinders; the horizontal direction), and at which the side surface of the alternator holding portion 13 (the side opposite to the cylinder block 2) is open.

A shank 15*a* of a bolt 15 (a bolt for allowing the alternator 4 to be held by the cylinder block 2, as will be described later) is inserted into the horizontal groove 14 horizontally laterally toward the cylinder block 2. After the shank 15*a* of the bolt 15 is inserted into the horizontal groove 14, the shank 15*a* of the bolt 15 is borne by a lower surface 14*a* of the horizontal groove 14. In this manner, the alternator 4 is supported by the cylinder block 2 (see FIG. 1).

Figure 5:
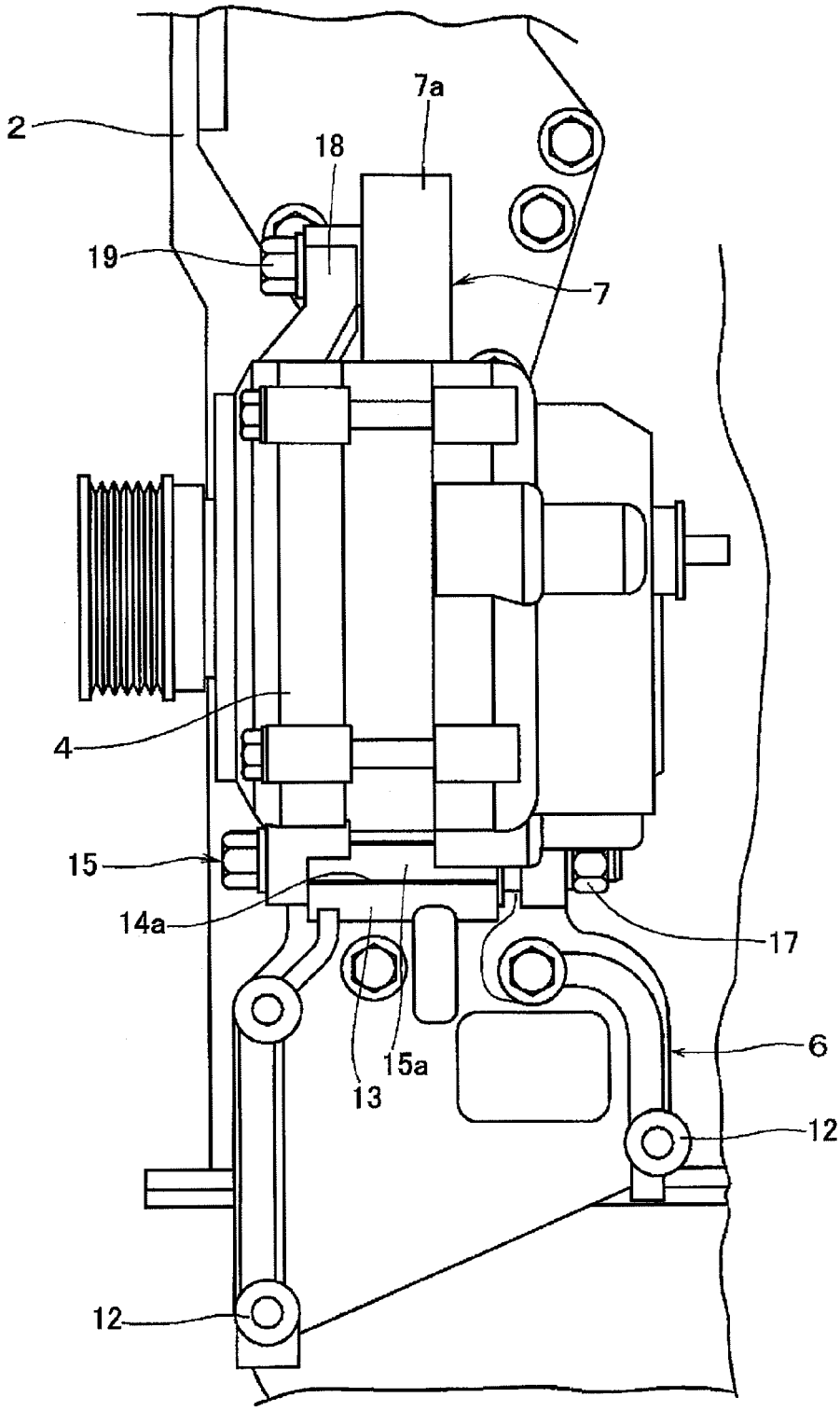
FIG. 5 is a detail drawing of a mounting portion for the alternator.

As shown in FIGS. 5 and 7, a pair of mounting pieces 16 are provided on a lower side of the alternator 4, and these mounting pieces 16 are formed at a site where they are located at both ends of the alternator holding portion 13 of the alternator bracket 6 (both ends of the horizontal groove 14).

The bolt 15 is inserted through the pair of mounting pieces 16, and a nut 17 is fastened to the bolt 15 from outside one of the mounting pieces 16 (the right-hand mounting piece in FIG. 7). In the drawing, the numeral 21 denotes a bush for adjusting the clearance between the one mounting piece 16 (the right-hand mounting piece in FIG. 7) and the alternator holding portion 13.

As shown in FIGS. 2 and 5, a fixing boss portion 18 is provided on an upper side of the alternator 4, and the fixing boss portion 18 is fixed to a fixing portion 7*a* of the PS bracket 7 by a fixing bolt 19.

That is, as shown in FIG. 1, the fixing portion 7*a* for fixing the fixing boss portion 18, which is the upper side of the alternator 4, is provided in the PS bracket 7. When the alternator bracket 6 is fixed to the cylinder block 2, the horizontal groove 14 is located close to the outer wall surface of the cylinder block 2. The fixing portion 7*a* of the PS bracket 7 (the fixing boss portion 18) is located to be more spaced from the outer wall surface of the cylinder block 2 than the horizontal groove 14. After the shank 15*a* of the bolt 15 is inserted into the horizontal groove 14, the shank 15*a* of the bolt 15 is borne by the lower surface 14*a* of the horizontal groove 14.

An example of fixing the fixing boss portion 18 to the fixing portion 7*a* of the PS bracket 7 is described above. However, it is possible to provide the alternator bracket 6 with a fixing portion for fixing the fixing boss portion 18.

Mounting of the alternator 4 in the above-described mounting structure will be described.

Figure 8A:
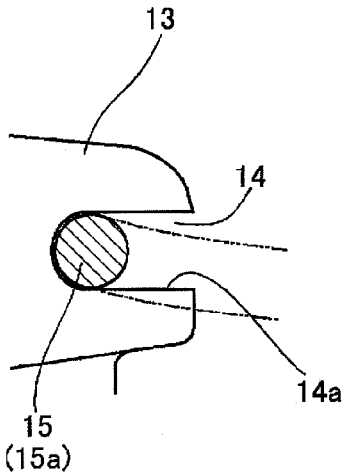
FIGS. 8A and 8B are conceptual drawings of the fixed status of the alternator.
Figure 8B:
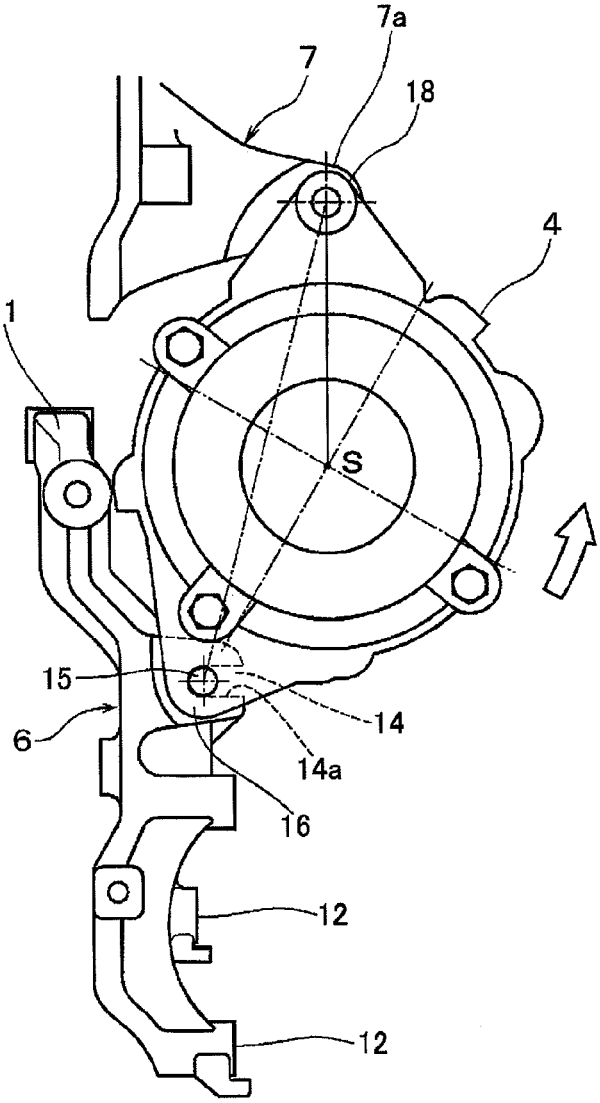

As shown in FIGS. 7 and 8A, 8B, the bolt 15 is inserted through the pair of mounting pieces 16, and then the nut 17 is fastened to a threaded part of the bolt 15 from outside the one mounting piece 16 (the right-band mounting piece in FIG. 7) for the bolt 15 to fix the bolt 15 to the alternator 4 tentatively.

In this state, the bolt 15 is inserted into the horizontal groove 14 of the alternator holding portion 13 from a lateral direction toward the cylinder block 2 (see FIG. 8A) to support the shank 15*a* of the bolt 15 by the lower surface 14*a* of the horizontal groove 14, and have the shank 15*a* of the bolt 15 shoulder the weight of the alternator 4.

The horizontal groove 14 is designed to be a groove having an opening at the side surface of the alternator holding portion 13. Thus, the alternator 4 is held such that the position of the bolt 15 is at the height of the horizontal groove 14, and the alternator 4 is moved from the lateral direction toward the cylinder block 2 so that the bolt 15 moves in the horizontal direction. By so doing, the alternator 4, which is a heavy object, can be held by the alternator bracket 6.

Hence, there is no need to lift the alternator 4, which is a heavy object, to a high position, thus lessening the labor. After the insertion of the bolt 15, the weight of the alternator 4, which is a heavy object, is borne within the lower surface 14*a* of the horizontal groove 14. As a result, the alternator 4, which is a heavy object, is held stably, and the labor of supporting the alternator 4 is lightened, so that the handling of the alternator 4 becomes easy.

After the shank of the bolt 15 is inserted in the lower surface 14*a* of the horizontal groove 14, the alternator 4 is turned about the axis of the bolt 15, as indicated by an arrow in FIG. 5B, to position the fixing boss portion 18 at the fixing portion 7*a* (fixed position) of the PS bracket 7.

In this state, the fixing boss portion 18 is fixed to the fixing portion 7*a* of the PS bracket 7 by the fixing bolt 19, and also the nut 17 is fastened to the threaded part of the bolt 15. By such means, with the pair of mounting pieces 16 sandwiching the alternator holding portion 13 of the alternator bracket 6, the mounting pieces 16 are fixed to the alternator bracket 6.

At this time, as shown in FIG. 8B, the center of gravity of the alternator 4 is located outside a line connecting the bolt 15 to the fixing bolt 19, and a turning force acts on the alternator 4 under its own weight. However, the shank 15*a* of the bolt 15 is supported by the lower surface 14*a* of the horizontal groove 14, so that the bolt 15 does not escape from the horizontal groove 14. In other words, after the bolt 15 is inserted, the bolt 15 is restrained from moving (S) toward the opening of the horizontal groove 14.

Since the shank of the bolt 15 is supported by the lower surface 14*a* of the horizontal groove 14, moreover, an excessive force does not act on the fixing bolt 19, and a burden on the upper fixing portion is reduced.

In detail, if the fixing bolt 19 is inserted and removed to repeat the mounting and removal of the alternator 4, with excessive force acting on the fixing bolt 19, the bolt hole wears under the own weight of the alternator 4, resulting in a decreased mounting accuracy.

With the mounting structure of the above-described embodiment, the shank 15*a* of the bolt 15 is supported by the lower surface 14*a* of the horizontal groove 14, and the own weight of the alternator 4 is borne thereby. Even upon repeated insertion and removal of the fixing bolt 19, therefore, the bolt hole does not wear, and the mounting accuracy of the alternator 4 can be kept high.

Since the mounting accuracy of the alternator 4 is kept high, the coplanarity of the pulley of the alternator 4 and the pulley of the crankshaft can be maintained.

Thus, it becomes possible to mount the alternator 4 on the cylinder block 2 with good work efficiency and with support accuracy kept high.

Figure 6:
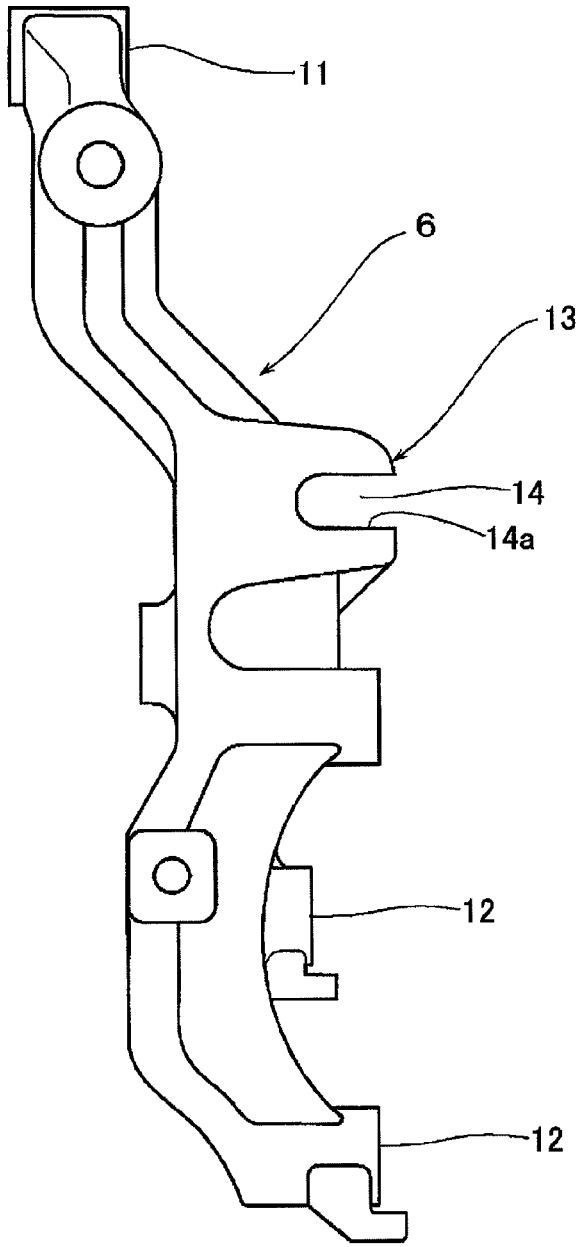
FIG. 6 is an external view of the accessory mounting bracket.

Furthermore, as shown in FIG. 6, the horizontal groove 14 is formed as a groove which is open at the side surface of the alternator holding portion. Thus, if the alternator bracket 6 is a cast product, its shape facilitates its release from the mold during the casting process.

The present invention can be utilized in the industrial field of a mounting structure for an accessory to be mounted on a vehicle engine.

While the present invention has been described in the foregoing fashion, it is to be understood that the invention is not limited thereby, but may be varied in many other ways. In the above embodiment, for example, mounting of the alternator 4 is used to describe the mounting structure for the accessory. However, the mounting structure can be applied to the mounting of the power steering pump or the air compressor. Such variations are not to be regarded as a departure from the spirit and scope of the invention, and all such modifications as would be obvious to one skilled in the art are intended to be included within the scope of the appended claims.

What is claimed is:

1. An accessory mounting structure for mounting an accessory to a cylinder block of an engine, comprising:

an accessory mounting bracket attached to the cylinder block; and a bolt for fastening a mounting piece provided on a lower side of the accessory to the accessory mounting bracket, wherein, the accessory mounting bracket includes a horizontal groove, which extends horizontally and is open at a side surface of the accessory mounting bracket on a side opposite to the cylinder block when the accessory mounting bracket is fixed to the cylinder block, and wherein the horizontal groove is configured to receive a shank of the bolt through an opening of the horizontal groove, such that the bolt is borne by a lower surface of the horizontal groove while restraining the bolt from moving toward the opening of the horizontal groove, and the horizontal groove allows the accessory to turn, within the horizontal groove, about an axis of the bolt, as a fulcrum, for positioning an upper side of the accessory.

2. The accessory mounting structure according to claim 1, further comprising:

a fixing portion to which the upper side of the accessory is fixed, and wherein when the accessory mounting bracket is fixed to the cylinder block, the horizontal groove is located near an outer wall surface of the cylinder block, and the fixing portion is located to be more spaced from the outer wall surface of the cylinder block than the horizontal groove, and the shank of the bolt is borne by a lower surface of the horizontal groove.

3. The accessory mounting structure according to claim 1, wherein an opening of the horizontal groove extends along a rotational axis of a crankshaft accommodated in the cylinder block and faces away from the cylinder block.

* * * * *